United States Patent [19]

Brinsley

[11] Patent Number: 4,762,970

[45] Date of Patent: Aug. 9, 1988

[54] ELONGATE PRESSURE ACTUATED ELECTRICAL SWITCH

[75] Inventor: Peter A. Brinsley, Warrington, England

[73] Assignee: BICC Public Limited Company, London, England

[21] Appl. No.: 85,976

[22] Filed: Aug. 14, 1987

[30] Foreign Application Priority Data

Aug. 22, 1986 [GB] United Kingdom ..... 8620474

[51] Int. Cl.[4] ..... H01H 3/14

[52] U.S. Cl. ..... 200/86 R; 200/85 R; 340/666

[58] Field of Search ..... 340/665, 666, 667, 933; 200/85 R, 85 A, 86 R, 86 A, 61.19, 61.41, 86.5, 333; 174/29, 115; 307/119

[56] References Cited

U.S. PATENT DOCUMENTS

| | | | |
|---|---|---|---|
| 3,277,256 | 10/1966 | Jones | 200/86 R |
| 3,748,373 | 7/1973 | Remy | 200/85 R |
| 3,778,805 | 12/1973 | Gould | 200/85 R |
| 4,060,705 | 11/1977 | Peachey | 200/86 R |
| 4,268,714 | 5/1981 | Mori | 174/115 |
| 4,551,713 | 11/1985 | Aossey | 200/85 R |
| 4,603,241 | 7/1986 | Nardi | 200/86 R |
| 4,649,228 | 3/1987 | Suzuki | 174/115 |

FOREIGN PATENT DOCUMENTS

| | | | |
|---|---|---|---|
| 272893 | 8/1928 | United Kingdom | 200/86 R |

*Primary Examiner*—G. P. Tolin

*Attorney, Agent, or Firm*—Anthony J. Casella; Gerald E. Hespos

[57] ABSTRACT

A rugged pressure actuated cable switch especially suitable for use in road vehicle detection comprises a central elongate conductor; a flexible insulating element helically wound around central conductor; a flexible tubular body of electrically conductive plastics material surrounding the central conductor; two elongate conductors in electrical contact with the outer surface of the flexible tubular body, and an overall insulating sheath of a transverse cross-section of approximately semi-circular shape having a flat surface for supporting the cable switch on the ground. Each outer conductor is embedded in the sheath alongside the flexible electrically conductive tubular body at a position intermediate of the flat surface and the longitudinal axis of the central conductor. When a pressure is applied to a part of the overall outer sheath remote from its flat surface, the central conductor is urged in a direction towards the flat surface to effect electrical contact with the two outer conductors via the flexible electrically conductive tubular body.

9 Claims, 1 Drawing Sheet

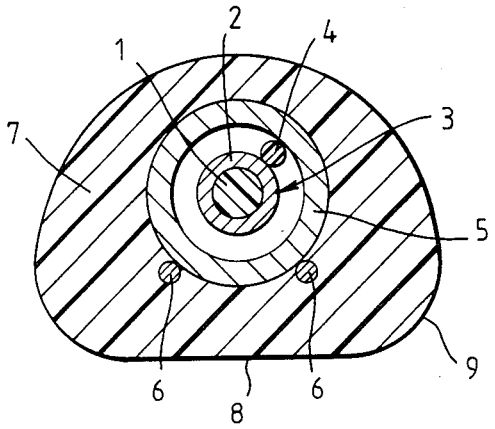
1
2
3
4
5
6
6
7
8
9

ELONGATE PRESSURE ACTUATED ELECTRICAL SWITCH

This invention relates to elongate pressure actuated electrical switches operable by pressure applied at substantially any position along their lengths.

It is common practice to employ an elongate pressure actuated electrical switch for road vehicle detection for many purposes differing from one another. Such purposes include effecting a survey of the amount of traffic using a particular road, operating traffic signals, operating a warning of the approach of a vehicle, and operating a gate or garage doors. Many forms of such elongate pressure actuated electrical switches have been proposed and used for road vehicle detection but many, if not all, of such switches fail after an unacceptable low number of cycles of actuation.

It is an object of the present invention to provide an improved elongate pressure actuated electrical switch which is rugged in construction and which is especially, but not exclusively, suitable for use in road vehicle detection.

According to the invention, the improved elongate pressure actuated electrical switch comprises a central elongate electric conductor; a flexible elongate element of electrically insulating material helically wound around the central conductor; a flexible tubular body of electrically conductive material which is coaxial with and surrounds the central conductor; at least one outer electric conductor in electrical contact with the outer surface of said flexible electrically conductive tubular body; and an overall outer sheath of electrically insulating material; and is characterised in that the or each outer conductor is of elongate form and extends lengthwise alongside the electrically conductive tubular body, in that the overall outer electrically insulating sheath has at least one substantially flat surface for supporting the elongate electrical switch on the ground and in that the or each elongate outer conductor is embedded in the overall outer sheath at a position intermediate of said substantially flat surface of the sheath and the central longitudinal axis of the central conductor.

The arrangement is such that, when the elongate switch is laid on the ground with the substantially flat surface of its outer electrically insulating sheath in interfacial contact with the surface of the ground, the central conductor and the or each outer conductor are normally insulated from one another by the helically wound flexible element of insulating material but, when sufficient downwardly directed pressure is applied to the outer sheath, the central conductor makes electrical contact with the outer conductor or at least one of the outer conductors via the flexible electrically conductive tubular body.

Preferably, the improved elongate pressure actuated electrical switch includes two or more than two outer elongate electric conductors in electrical contact with the outer surface of the flexible electrically conductive tubular body at positions spaced circumferentially, and preferably uniformly, around that part of the flexible electrically conductive tubular body lying intermediate of the substantially flat surface of the overall outer electrically insulating sheath and the central longitudinal axis of the central conductor. In this case, preferably the overall outer electrically insulating sheath of the elongate pressure actuated electrical switch is of such a transverse cross-sectional shape that, when a pressure is applied to a part of the overall outer sheath remote from its substantially flat surface, the central conductor is urged in a direction towards the substantially flat surface of the sheath to effect electrical contact with said two outer conductors, or with at least two of said outer conductors, via the flexible electrically conductive tubular body.

Where the preferred elongate pressure actuated electrical switch is to be used for road vehicle detection, the overall outer electrically insulating sheath will be of such a transverse cross-sectional shape and thickness and of such an electrically insulating material that the switch cannot be activated by pedestrians. It will be appreciated that the improved elongate pressure actuated electrical switch is not restricted to use for road vehicle detection and, by appropriate selection of the transverse cross-sectional shape, thickness and insulating material of the overall outer sheath, the improved electrical switch can be used for many other purposes, included among which are an alarm switch to be used for operation by employees in banks, post offices and other establishments open to the public where there is a risk of robbery and for other security purposes, and an alarm switch secured to the periphery of a mobile robot for sensing when the robot comes into unintentional contact with another body. In all cases, preferably the overall outer sheath has a transverse cross-sectional shape of approximately semi-circular form, those parts of the outer surface adjoining the substantially flat surface being smoothly rounded.

Where the improved elongate pressure actuated electrical switch is to be employed in a permanent installation, the outer face of the substantially flat surface of the overall outer sheath may carry a layer of pressure-sensitive adhesive by means of which the electrical switch can be stuck to the surface of the ground or other surface or the overall outer sheath may have protruding outwardly from one or each side of that part of the sheath having a substantially flat surface a longitudinally extending flange through which the switch can be secured to the surface of the ground or other surface by nails, screws or other separately formed fastening means.

The central conductor preferably comprises an elongate strain member of electrically insulating material having an outer coating of an electrically conductive material, e.g. graphite loaded plastics material. The flexible elongate element of electrically insulating material helically wound around the central conductor preferably comprises a thread of polyethylene or other suitable electrically insulating plastics material. The flexible tubular body of electrically conductive material surrounding the central conductor may have an electrical conductivity less than that of the or each elongate outer conductor and is preferably made of an electrically conductive plastics material, e.g. a graphite loaded plastics material. The or each elongate outer conductor may comprise a plurality of stranded copper wires or a plurality of tinsel threads. The overall outer sheath is preferably made of polyurethane or other suitable plastics material.

The improved elongate pressure actuated electrical switch of the present invention can be successfully actuated at least half a million times without failure.

The invention is further illustrated by a description, by way of example, of a preferred elongate pressure actuated electrical switch with reference to the accompanying drawing which shows a transverse cross-sectional view of the switch drawn on an enlarged scale.

Referring to the drawing, the preferred elongate pressure actuated electrical switch comprises an elongate strain member 1 of aromatic polyamide having an outer coating 2 of an electrically conductive material such as graphite loaded plastics material, the electrically conductng coated strain member constituting a central elongate electric conductor 3. A thread 4 of polyethylene is helically wound around the central conductor 3 and a flexible tubular body 5 of electrically conductive material such as a graphite loaded plastics material is coaxial with and is radially spaced by the polyethylene thread from the central conductor. Two outer conductors 6 of elongate form, each comprising a plurality of stranded copper wires, extend lengthwise in electrical contact with the outer surface of the flexible electrically conductive tubular body 5 at positions spaced circumferentially and uniformly around that part of the flexible electrically conductive tubular body lying intermediate of the central longitudinal axis of the central conductor 3 and a flat surface 8 of an overall outer sheath 7 of polyurethane. As will be seen, the overall outer sheath 7 has a transverse cross-sectional shape of approximately semi-circular form, those parts 9 of its outer surface adjoining the flat surface 8 being smoothly rounded. The flexible electrically conductive tubular body 5 has an electrically conductivity less than that of the outer conductors 6.

The elongate pressure actuated electrical switch has an overall height of 6.95 mm and a maximum transverse width of 9.50 mm and is especially suitable for use in road vehicle detection.

When the elongate switch is laid on the ground with the flat surface 8 of its overall outer sheath 7 in interfacial contact with the surface of the ground, the electrically conductive coating 2 of the central conductor 3 and each outer conductor 6 are normally insulated from one another by the helically wound polyethylene thread 4. When downwardly directed pressure is applied to the outer sheath 7 by a vehicle passing over the electrical switch, the electrically conductive coating 2 of the central conductor 3 is urged in a direction towards the flat surface 8 of the sheath 7 to effect electrical contact with the two outer conductors 6 via the flexible electrically conductive tubular body 5.

What I claim as my invention is:

1. An elongate pressure actuated electrical switch comprising a central elongate electric conductor; a flexible elongate element of electrically insulating material helically wound around the central conductor; a flexible tubular body of electrically conductive material which is coaxial with and surrounds the central conductor; at least one outer electric conductor in electrical contact with the outer surface of said flexible electrically conductive tubular body; and an overall outer sheath of electrically insulating material, wherein the outer conductor is of elongate form and extends lengthwise alongside the flexible electrically conductive tubular body, the overall outer electrically insulating sheath has at least one substantially flat surface for supporting the elongate electrical switch on the ground and the elongate outer conductor is embedded in the overall outer sheath at a position intermediate of said substantially flat surface of the sheath and the central longitudinal axis of the central conductor.

2. An elongate pressure actuated electrical switch as claimed in claim 1, wherein at least two outer elongate electric conductors are in electrical contact with the outer surface of the flexible electrically conductive tubular body at positions spaced circumferentially around that part of the flexible electrically conductive tubular part lying intermediate of the substantially flat surface of the overall outer electrically insulating sheath and the central longitudinal axis of the central conductor.

3. An elongate pressure actuated electrical switch as claimed in claim 2, wherein the overall outer electrically insulating sheath is of such a transverse cross-sectional shape that, when a pressure is applied to part of the overall outer sheath remote from its substantially flat surface, the central conductor is urged in a direction towards the substantially flat surface of the sheath to effect electrical contact with said two outer conductors via the flexible electrically conductive tubular body.

4. An elongate pressure actuated electrical switch as claimed in claim 3, wherein the outer elongate electric conductors are uniformly spaced around that part of the flexible electrically conductive tubular body lying intermediate of the substantially flat surface of the overall outer electrically insulating sheath and the central longitudinal axis of the central conductor and wherein the overall outer sheath has a transverse cross-sectional shape of approximately semi-circular form, those parts of the outer surface adjoining the substantially flat surface being smoothly rounded.

5. An elongate pressure actuated electrical switch as claimed in claim 1, wherein the flexible elongate element of electrically insulating material helically wound around the central conductor comprises a thread of electrically insulating plastics material.

6. An elongate pressure actuated electrical switch as claimed in claim 1, wherein the flexible tubular body of electrically conductive material surrounding the central conductor is made of an electrically conductive plastics material.

7. An elongate pressure actuated electrical switch as claimed in claim 1, wherein the elongate outer conductor comprises a plurality of stranded copper wires.

8. An elongate pressure actuated electrical switch as claimed in claim 1, wherein the elongate outer conductor comprises a plurality of tinsel threads.

9. An elongate pressure actuated electrical switch as claimed in claim 1, wherein the overall outer sheath is made of plastics material.

* * * * *